United States Patent [19]

Nakamura

[11] Patent Number: 4,851,797

[45] Date of Patent: Jul. 25, 1989

[54] ½ WAVELENGTH SIDE COUPLED FILTER

[75] Inventor: Makio Nakamura, Osaka, Japan

[73] Assignee: Sharp Kabushiki Kaisha, Osaka, Japan

[21] Appl. No.: 225,847

[22] Filed: Jul. 28, 1988

[30] Foreign Application Priority Data

Jul. 29, 1987 [JP] Japan ..... 62-115965[U]
Sep. 17, 1987 [JP] Japan ..... 62-233371

[51] Int. Cl.[4] ..... H01P 1/203; H01P 1/213

[52] U.S. Cl. ..... 333/134; 333/204; 333/246

[58] Field of Search ..... 333/126–129, 333/134, 136, 204, 205, 202, 246, 1, 4, 5, 100, 33, 35

[56] References Cited

U.S. PATENT DOCUMENTS 4,168,479 9/1979 Rubin ..... 333/126
4,757,286 7/1988 Konishi et al. ..... 333/204

FOREIGN PATENT DOCUMENTS 444286 6/1975 U.S.S.R. ..... 333/205
1240860 7/1971 United Kingdom .
2170358 7/1986 United Kingdom ..... 333/128

OTHER PUBLICATIONS

IEEE Transactions on Microwave Theory and Techniques, Oct. 1972, pp. 696–699, MTT-20.
IEEE Transactions on Microwave Theory and Techniques, MIT-13, (1965.01), pp. 91–95.

*Primary Examiner*—Marvin L. Nussbaum
*Attorney, Agent, or Firm*—Birch, Stewart, Kolasch & Birch

[57] ABSTRACT

In a ½ wavelength side coupling filter, a plurality of resonance lines (4) are arranged on a board (20) in parallel to each other in a staggered manner so that respective ends thereof have step portions. An input coupling line (3) is arranged in parallel to the plurality of resonance lines, with an input end (5) formed opposed to an intermediate position of the adjacent resonance line and one end portion (6) formed aligned with one end portion of the adjacent resonance line. An adjusting line (7) is formed extending from one end portion (6) on the input coupling line, and the filtering characteristics adjusted by the adjusting line.

4 Claims, 3 Drawing Sheets

½ WAVELENGTH SIDE COUPLED FILTER

BACKGROUND OF THE INVENTION

1. Field of the Invention

The present invention relates to a ½ wavelength side coupling filter and, more specifically, to a ½ wavelength side coupling filter employed in, for example, a low noise converter for receiving satellite broadcasting.

2. Description of the Prior Art

FIGS. 1 to 3 are patterns of microstrip lines in conventional ½ wavelength side coupling filters.

First, referring to FIGS. 1 to 3, description will be given of a conventional ½ wavelength side coupling filter. In FIG. 1, a plurality of resonance lines 4 are arranged on a printed board 20 in parallel to each other in the horizontal direction in a staggered manner. An input coupling line 3 is arranged adjacent to the resonance line 4 on one end. A signal input end 1 is formed extending from the input end 5 of the input coupling line 3, and signals are inputted to the signal input end 1. The end portion 6 of the input coupling line 3 is formed such that it is aligned with an intermediate position of the resonance line 4. Only the signal components in a prescribed band out of the signals inputted to the input end 1 are outputted from an output end 2 of the resonance line 4 of the last stage.

The length from the input end 1 to the output end 2 of the ½ wavelength side coupling filter structured as described above should be longer than a prescribed length. However, if other parts and the like are arranged in the x direction limiting the space, the arrangement of the pattern shown in FIG. 1 cannot be employed.

In the ½ wavelength side coupling filter shown in FIG. 2, the input coupling line 3 and a plurality of zonal resonance lines are arranged in the vertical direction, with the input end of the input coupling line 3 bent by 90° in the horizontal direction, and the output end 2 of the resonance line 4 in the last stage bent by 90° in the horizontal direction. The ½ wavelength side coupling filter of this pattern arrangement is advantageous when there is a limit in the x direction but not in the y direction in arranging the pattern on the board 20. However, if other parts are arranged in the y direction, it is disadvantageous if the space is taken into consideration.

Since the limit of space makes it difficult to arrange the ½ wavelength side coupling filters shown in FIGS. 1 and 2, a pattern arrangement such as shown in FIG. 3 can be resorted to. In the example shown in FIG. 3, the input coupling line 3 and a plurality of resonance lines 4 are arranged with inclination, with the input end 1 and the output end 2 bent so as to be oriented in the horizontal direction. The ½ wavelength side coupling filter having such pattern arrangement is more available than the examples shown in FIGS. 1 and 2, even if the space is limited both in the x and y directions. However, the filte has a disadvantage such as follows. The ½ wavelength side coupling filter shown in FIG. 3 has its input coupling line 3 and the resonance lines 4 formed by etching. In order to make an original drawing for fabricting films for etching, the angle factors in the x and y directions are required, the check for each of the coordinates becomes complicated, and the check of modification of the dimension becomes difficult.

SUMMARY OF THE INVENTION

Therefore, an object of the present invention is to provide a ½ wavelength side coupling filter which enables effective use of a space.

Another object of the present invention is to provide a ½ wavelength side coupling filter whose original drawing for manufacturing a pattern can easily be made.

Briefly stated, in the present invention, a plurality of resonance lines are arranged on a board or substrate in parallel with each other in a staggered manner with end portions of respective lines having steps; an input coupling line is arranged in parallel to these resonance lines, with an input end of the input coupling line provided opposed to an intermediate position of the adjacent resonance line, one end of the input coupling line formed aligned with one end of the adjacent resonance line; an adjusting line is provided so as to extend the end portion of the input coupling line; and the filtering characteristics are adjusted by the adjusting line.

Therefore, according to the present invention, the space can effectively used in arranging the pattern on the board, and in addition, the original drawing for fabricating the pattern can easily be made.

In another aspect, in the present invention a power distributing means for distributing inputted signals comprising microstrip lines and a resistance is arranged on a board; and two filter means are formed from output ends of the power distributing means with the distance between each other widening toward the ends, each comprising a microstrip line having different passband.

Therefore, according to another aspect of the present invention, ½ wavelength side coupling filters having different passbands can be formed on one board, whereby the structure of the circuit can be simplified and the cost thereof can be reduced.

In a preferred embodiment in accordance with another aspect of the present invention, the power distributing means comprises an input end to which signals are inputted, and two branching ends branching the signals inputted to the input end with a resistance connected therebetween; and the filter means comprises a plurality of zonal resonance lines arranged in parallel to each other in a staggered manner with an end portion of each line having a step portion, an input coupling line arranged in parallel to the plurality of resonance lines with an input end of the input coupling line provided opposed to an intermediate position of an adjacent resonance line and one end portion of the input coupling line formed aligned with one end portion of the adjacent resonance line, and an adjusting line provided extending from the end portion of the input coupling line, with the filtering characteristics adjusted by the adjusting line.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 4:
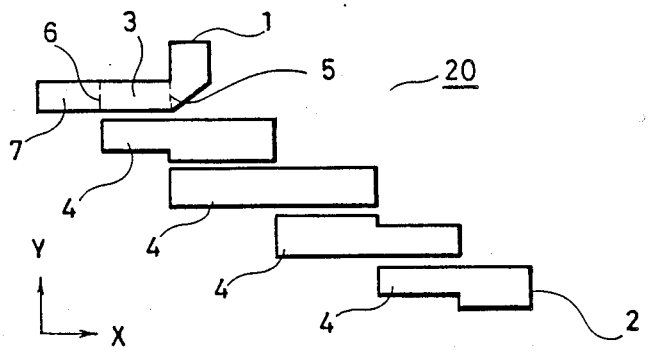
FIG. 4 is a pattern of one embodiment of the present invention.

FIG. 4 is a pattern of one embodiment of the present invention.

Figure 1:
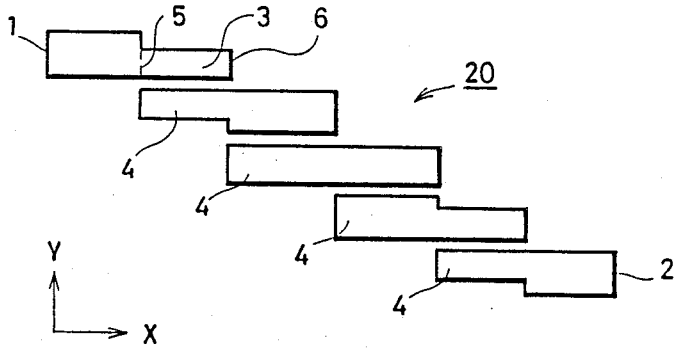
FIG. 1 PRIOR ART
FIGS. 1, 2 and 3 are patterns of conventional ½ wavelength side coupling filters.
Figure 2:
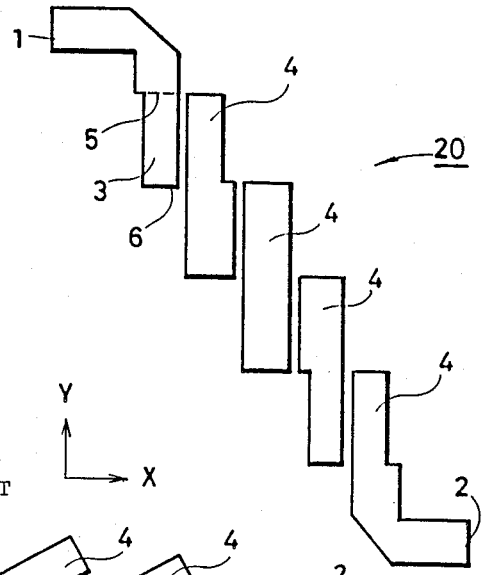
FIG. 2 PRIOR ART

Referring to FIG. 4, a plurality of resonance lines 4 are arranged in parallel with each other in the horizontal direction in a so-called staggered manner with end portions of the respective lines having steps in succession, in the similar manner as the conventional one shown in FIG. 1. An input coupling line 3 is provided adjacent to a resonance line 4 at one end, with one end portion of the input coupling line 3 formed aligned with one end portion of the adjacent resonance line 4, and an adjusting line 7 having the same width as the input coupling line 3 is provided extending from one end of the input coupling line 3. The adjusting line 7 serves as a stub for adjusting the filtering characteristics. An input end 5 is formed on the other end portion of the input coupling line 3 so as to be positioned on the intermediate position of the adjacent resonance line 4. A signal input end 1 is formed extending from the input end to the direction crossing the adjacent resonance line 4.

Figure 3:
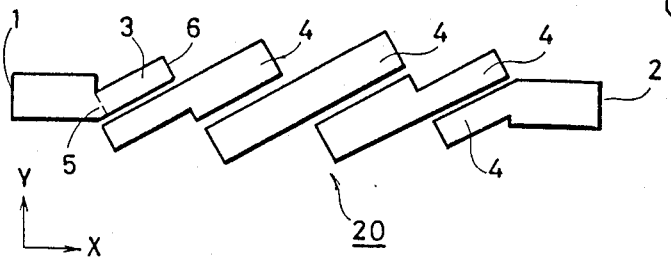
FIG. 3 PRIOR ART

Since the ½ wavelength side coupling filter is structured as described above, only the adjusting line 7 is projected from the end surface of the resonance line 4, whereby the length in the x direction can be reduced and the space in the y direction can also be reduced compared with the conventional one shown in FIG. 1. It is clear that the original drawing for forming the pattern of the resonance lines 4 and the input coupling line 3 can be made easier compared with the example shown in FIG. 3. In addition, a prescribed band characteristics as the filtering characteristic can be obtained by adjusting the length of the adjusting line 7, thereby providing a filter of superior characteristics.

Meanwhile, a dual band low noise converter capable of receiving signals of two different input frequency bands is used as a low noise converter for receiving satellite broadcasting. In such dual band low noise converter, two ½ wavelength side coupling filters are employed. In that case, the two ½ wavelength side coupling filters can possibly be coupled to each other to cause ripples in the filtering characteristics of each filter. In order to prevent such bad influences, two filters each structured in a separate unit and shielded should be used. Consequently, the circuit structure becomes complicated and expensive. Therefore, a dual band ½ wavelength side coupling filter which is inexpensive and capable of preventing degradation of two filtering characteristics will be described in the following.

Figure 5:
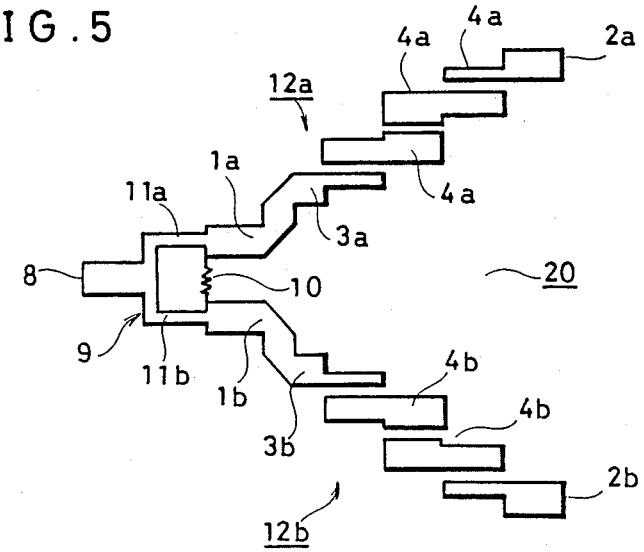
FIG. 5 is a pattern of a dual band ½ wavelength side coupling filter in accordance with another embodiment of the present invention.

FIG. 5 is a pattern of a dual band ½ wavelength side coupling filter in accordance with another embodiment of the present invention.

Referring to FIG. 5, a y shaped power distributing portion 9 formed of microstrip lines is provided on a board 20. The power distributing portion 9 comprises an input end 8 and two branching ends 11*a* and 11*b*, with a terminated resistance connected between the branching ends 11*a* and 11*b*. ½ wavelength side coupling filters 12*a* and 12*b* are respectively connected to the branching ends 11*a* and 11*b* with the distance between the filters widening toward the ends thereof. More specifically, as for the ½ wavelength side coupling filter 12*a*, the input end 11*a* of the input coupling line 3*a* is connected to the branching end 11*a*, and a plurality of resonance lines 4*a* are provided in parallel to the input coupling line 3*a*.

As for the other ½ wavelength side coupling filter 12*b*, it is structured in the similar manner as the ½ wavelength side coupling filter 12*a*, comprising an input coupling line 3*b* and a plurality of resonance lines 4*b*. Signals are inputted from a low noise amplifier, not shown, to the input end 8 of the power distributing portion 9. The signals are branched into the branching ends 11*a* and 11*b* to be outputted at the output ends 2*a* and 2*b* through the ½ wavelength side coupling filters 12*a* and 12*b*, with respective signals inputted to mixer circuits, not shown.

Figure 6:
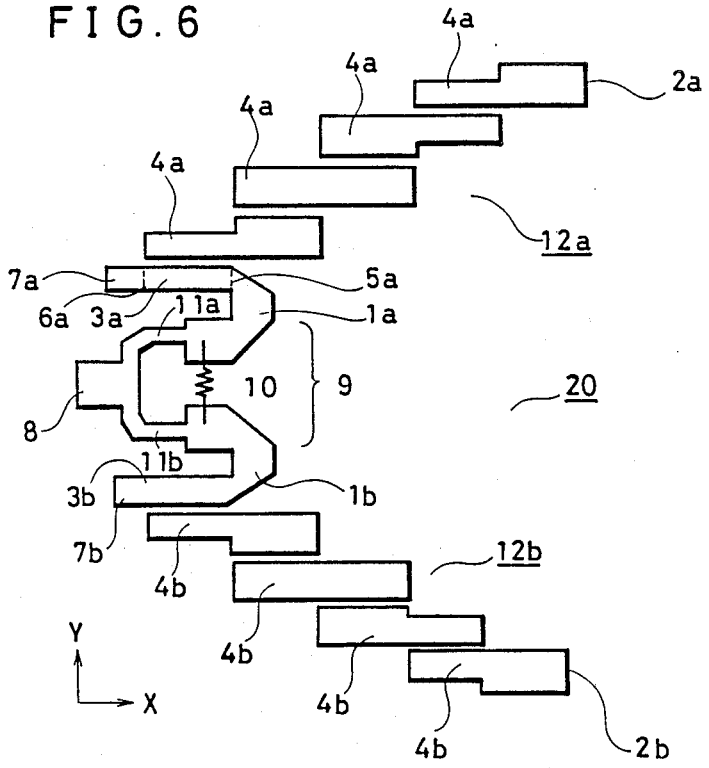
FIG. 6 is a pattern of a dual band ½ wavelength side coupling filter in accordance with a further embodiment of the present invention.

FIG. 6 is a pattern of a dual band ½ wavelength side coupling filter in accordance with a further embodiment of the present invention.

The embodiment shown in FIG. 6 is the same as the embodiment shown in FIG. 5 except the following points. Namely, one input coupling line 3*a* is formed in parallel to an adjacent resonance line 4*a*, an adjusting line 7*a* is formed protruding from one end 6*a* thereof, and a signal input end 1*a* is formed on an input end 5*a* of the input coupling line 3*a* extending in the direction crossing the input coupling line 3*a* and the branching end 11*a*.

The other input coupling line 3*b* and the signal input end 1*b* are formed in the similar manner. As described above, since the signal input ends 1*a* and 1*b* are formed in the direction crossing the input coupling lines 3*a* and 3*b*, the space to be occupied in the x direction can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A ½ wavelength side coupling filter having a plurality of zonal resonance lines arranged on a board in parallel to each other in a staggered manner with end portions thereof having successive steps, and side surfaces of respective resonance lines coupled electromagnetically with each other, comprising:

an input coupling line (3) arranged in parallel to said plurality of resonance lines, having an input end provided opposed to an intermediate position of an adjacent resonance line an one end formed aligned with one end portion of said adjacent resonance line, and an adjusting line (7) provided to extend an end portion on said input coupling line, having a width substantially equal to the width of said input coupling line, and serving as a stub for adjusting filtering characteristics.

2. A ½ wavelength side coupling filter having two different passbands provided on a board, comprising:

a Y shaped power distributing means (9) including a pair of like microstrip parallel line segments and a resistance arranged on said board between said line segments for distributing inputting signals;

two mutually diverging ½ wavelength side coupling filter means (12*a*, 12*b*) formed on said board extending from respective output ends of said line segments of said power distributing means with the distance between each other widening toward output end portions thereof and having respectively different passbands; and wherein each of said filter means (12*a*, 12*b*) further comprises;

a plurality of zonal resonances lines (4*a*, 4*b*) parallel to each other and arranged in a staggered manner so that respective end portions thereof have successive steps, and an input coupling line (3*a*, 3*b*) having an input end coupling to the output end of a responsive line segment of said line segments and a coupling end aligned parallel to an adjacent resonance line of said plurality of resonance lines.

3. A ½ wavelength side coupling filter according to claim 2 and additionally including an adjusting line (7*a*, 7*b*), having a width substantially the same as the width of said input coupling line, extending from the input end portion of said coupling line (3*a*, 3*b*) for adjusting the filter characteristic of the two filter means (12*a*, 12*b*).

4. A ½ wavelength side coupling filter having two different passbands provided on a board, comprising:

a bifurcated power distributing means (9) including a pair of like microstrip parallel line segments and a resistance arranged on said board between said line segments for distributing inputted signals;

two mutually diverging ½ wavelength side coupling filter means (12*a*, 12*b*) formed on said board extending from respective output ends of said line segments of said power distributing means with the distance between each other widening toward output end portions thereof and having respectively different passbands;

wherein each of said filter means (12*a*, 12*b*) further comprises;

a plurality of zonal resonance lines (4*a*, 4*b*) parallel to each other and arranged in a staggered manner so that respective end portions thereof have successive steps, an input coupling line (3*a*, 3*b*) having an input end coupled to the output end of a respective line segment of said lines segments and a coupling end aligned parallel to an adjacent resonance line of said plurality of resonance lines; and an adjusting line (7*a*, 7*b*), having a width substantially the same as the width of said input coupling line, extending from the input end of said coupling line (3*a*, 3*b*) for serving as a stub for adjusting the respective filter characteristics of each said filter means (12*a*, 12*b*).

* * * * *